US006009803A

United States Patent [19]

Pankoke et al.

[11] Patent Number: 6,009,803

[45] Date of Patent: Jan. 4, 2000

[54] DOUBLE BAND PRESS FOR MAKING AND/OR COATING PLATE-SHAPED OR WEB-SHAPED WORKPIECES OF ALL TYPES

[75] Inventors: Werner Pankoke, Bielefeld; Rolf Röttger, Melle, both of Germany

[73] Assignee: Firma Theodor Hymmen, Bielefeld, Germany

[21] Appl. No.: 08/973,371

[22] PCT Filed: Apr. 2, 1997

[86] PCT No.: PCT/DE97/00667

§ 371 Date: Dec. 5, 1997

§ 102(e) Date: Dec. 5, 1997

[87] PCT Pub. No.: WO97/39882

PCT Pub. Date: Oct. 30, 1997

[30] Foreign Application Priority Data

Apr. 20, 1996 [DE] Germany ..... 196 15 771

[51] Int. Cl.[7] ..... B30B 5/06; B30B 15/34

[52] U.S. Cl. ..... 100/308; 100/154; 100/310; 100/312; 156/583.5; 425/371

[58] Field of Search ..... 100/306–314, 100/151, 153, 154; 156/555, 583.5; 425/371

[56] References Cited

U.S. PATENT DOCUMENTS

| | | | |
|---|---|---|---|
| 2,826,986 | 3/1958 | Weiss | 100/154 |
| 3,795,470 | 3/1974 | De Mats | 100/151 |
| 4,311,550 | 1/1982 | Kerttula | 100/311 |
| 4,485,733 | 12/1984 | Held | 100/311 |
| 4,494,648 | 1/1985 | Held | 100/154 |
| 5,200,129 | 4/1993 | Kobayashi et al. | 425/371 |
| 5,558,016 | 9/1996 | De Brock | 100/312 |

FOREIGN PATENT DOCUMENTS

| | | | |
|---|---|---|---|
| 0 295 427 | 12/1988 | European Pat. Off. . | |
| 0 492 683 | 7/1992 | European Pat. Off. . | |
| 0 550 782 | 7/1993 | European Pat. Off. . | |
| 29 22 151 | 12/1980 | Germany . | |
| 30 28 145 | 2/1982 | Germany . | |
| 30 46 432 | 8/1982 | Germany . | |
| 6-304950 | 11/1994 | Japan | 100/311 |

OTHER PUBLICATIONS

Patent Abstracts of Japan, vol. 012, No. 257 (M–719) Jul. 20, 1988, 63–39309, Feb. 1988.

*Primary Examiner*—Stephen F. Gerrity
*Attorney, Agent, or Firm*—Henry M. Feiereisen

[57] ABSTRACT

A double press for making and/or coating of web-shaped or plate-shaped workpieces of all types includes a reaction zone in which the pressure load of the workpiece passing through the press, and the intensity of the heat transfer or the heat removal are designed to be adjustable for individual products over an extended range. Between the pressing rolls (9) and the pressure plate (6), there are disposed bearing rollers (10) associated with the pressing rolls. A liquid pressure-transmitting medium flows turbulently in a short circulatory loop through the pressure chamber and a heating or cooling unit (13) located outside the pressure chamber. The double band presses can be employed in the furniture and electrical industry as well as in other branches of industry where laminated materials are used or processed.

12 Claims, 3 Drawing Sheets

DOUBLE BAND PRESS FOR MAKING AND/OR COATING PLATE-SHAPED OR WEB-SHAPED WORKPIECES OF ALL TYPES

BACKGROUND OF THE INVENTION

The invention relates to a double band press for making and/or coating plate-shaped or web-shaped workpieces of all types, wherein the material to be pressed passes through a reaction zone between opposing band strands of two endless continuous-loop press bands, with pressure and heat applied to the material in the reaction zone, and wherein in the reaction zone, there is associated with each band strand at least one pressure chamber which is open on the side facing the band segment, with the pressure chamber including wraparound seals supported by the band strands and bounded on the side facing away from the band strand by a pressure plate and provided with pressure rolls supported on the band strand.

SUMMARY OF THE INVENTION

It is the object of the invention to enable in the reaction zone of the double band press an adjustment of the pressure load of the web-shaped or plate-shaped workpiece advancing through the press, and of the intensity of the heat transfer or the heat removal over a relatively large range in dependence on the product.

This object is solved in accordance with the invention by arranging between the pressure rolls and the pressure plate bearing rollers associated with the pressure rolls, by having a liquid pressure-transmitting medium flow turbulently in a short circulatory loop through the pressure chamber and through a heating unit or cooling unit located outside the pressure chamber, and by allowing adjustment of the operating pressure of the liquid pressure-transmitting medium or the velocity of the liquid pressure-transmitting medium in the pressure chamber for changing the intensity of the heat transfer.

The pressure applied to the workpiece in the region of the reaction zone of the double band press is defined by both the pressing rolls located in the pressure chamber or pressure chambers and the operating pressure of the liquid pressure-transmitting medium.

Since the liquid pressure-transmitting medium flows turbulently through the pressure chamber, the heat transfer from the heated pressure medium or cold transfer from the cooled pressure-transmitting medium onto the working strand of the press band and thus onto the workpiece is significantly improved in comparison to a laminar flow. The intensity of the heat supply to the workpiece or of the heat removal from the workpiece can be increased significantly by increasing the operating pressure or the velocity of the liquid pressure-transmitting medium. Consequently, the construction of the pressure chamber according to the invention makes it technically feasible to precisely adjust the pressure load and heat load individually for each workpiece in the reaction zone, i.e. in accordance with the technical problems encountered during the pressing operation.

The applied pressure and the supplied heat or amount of cooling can be regulated further by constructing the pressure chamber from several cassettes, wherein each cassette further comprises pressure rolls and bearing rollers rotatably supported in a frame, by providing a turbulent flow of a heated or cooled liquid pressure-transmitting medium through the pressure chamber, and by making it possible to individually adjust the operating pressure of the liquid pressure-transmitting medium in each cassette by adjustment means 4.2 shown in FIG. 4.

Additional features of the invention form the subject matter of the dependent claims.

BRIEF DESCRIPTION OF THE DRAWING

Exemplified embodiments of the invention are illustrated in the drawings, in which.

DETAILED DESCRIPTION OF PREFERRED EMBODIMENTS

Figure 1:
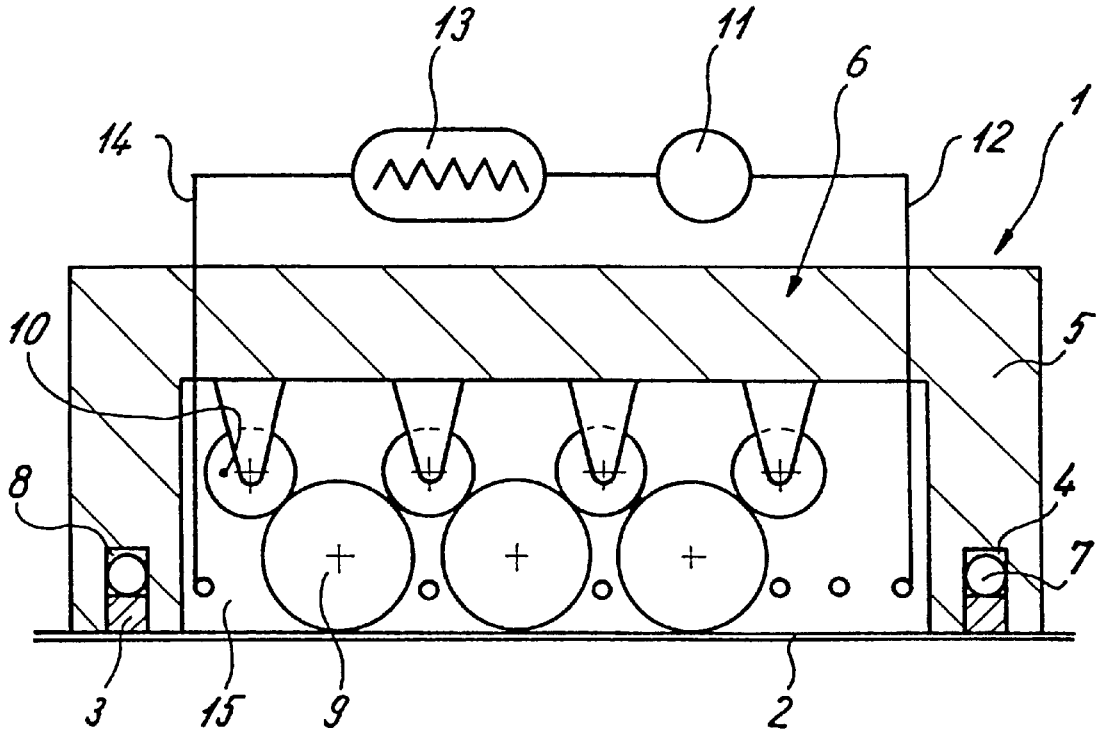
FIG. 1 shows schematically a pressure chamber associated with the working strand of a continuous press band.

In FIG. 1, the pressure chamber 1 is demarcated on the bottom side by the working strand of an endless press band 2 upon which a seal 3 is supported which is slideably supported in a wraparound groove 4 of the side walls 5 of a pressure plate 6. In the illustrated exemplified embodiment, the seal 3 is supported in the groove 4 by an O-ring 7 which on one side flanks a grooved chamber 8 into which a pressure-transmitting medium is introduced for biasing the seal 3 in force-locking manner against the press band 2.

Associated to the working strand of the press band 2 are pressure rolls 9 supported by bearing rollers 10.

The support of the bearing rollers is only schematically shown in FIG. 1. Both the bearing rollers 10 and the pressure rolls 9 can be rotatably supported in a frame secured to the pressure plate 6. For adjusting the height, both this frame and the pressure plate can be adjusted relative to the press band 2 with the help of piston-cylinder units.

During the operation of the press, a pressure-transmitting medium is moved turbulently in the pressure chamber in a short circulatory loop and withdrawn from the pressure chamber through a suction line 12 by means of a circulation unit 11 which can be implemented in form of a fan, compressor or pump; the pressure-transmitting medium is then conducted through a heating or cooling unit 13 and reintroduced into the interior space 15 of the pressure chamber through a pressure line 14. The pressure of the pressure-transmitting medium, which may be compressed air or hydraulic oil, can be adjusted with the help of a device which is not shown.

Figure 4:
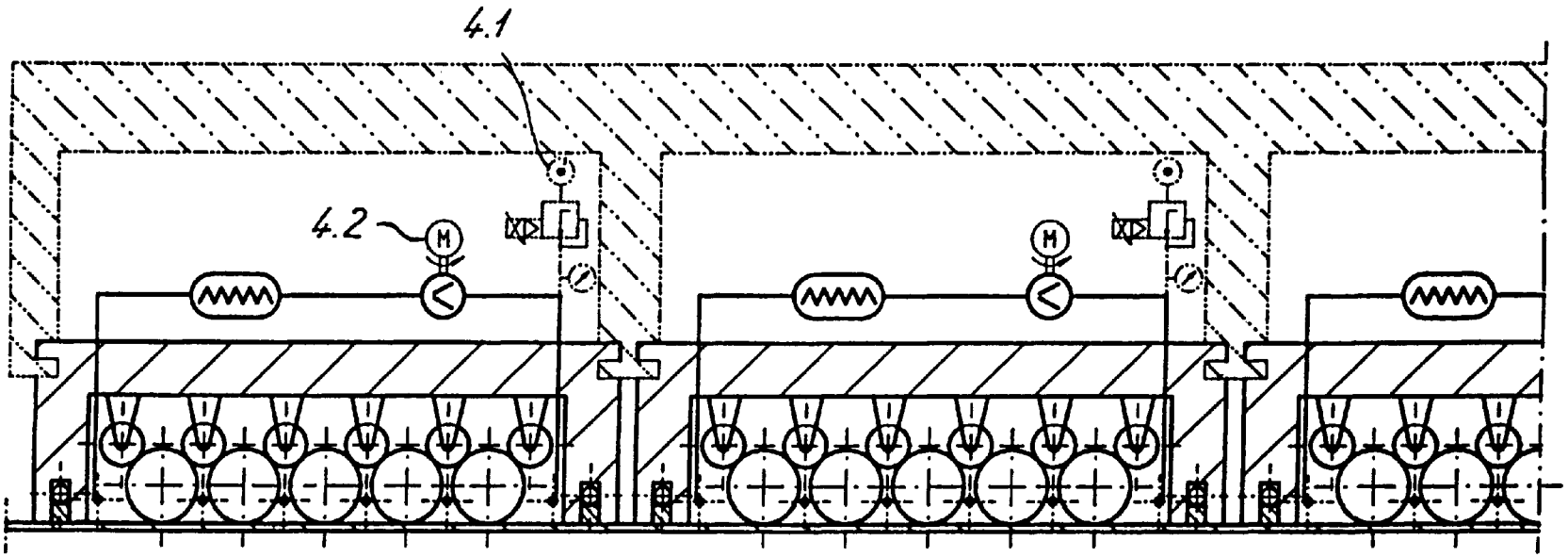
FIG. 4 shows schematically a pressure chamber constructed from several cassettes with means for adjusting the velocity of the pressure-transmitting medium and means for adjusting the operating pressure.

It is also possible to adjust the velocity with which the pressure-transmitting medium flows through the pressure chamber 1 shown as 4.1 in FIG. 4. The velocity is 2 to 50 m/sec for gaseous pressure-transmitting fluids, preferably 10 to 40 m/sec, and 4 to 5 m/sec for liquid pressure-transmitting fluids.

The transition from a laminar flow to a turbulent flow is determined by the Reynolds number which is $Re \geqq 2{,}300$ for turbulent flow.

The flow direction of the pressure-transmitting medium is generally the same as the transport direction of the material to be pressed by the band press. The flow direction of the pressure-transmitting medium can, however, also be opposite to the transport direction of the material to be pressed.

Figure 2:
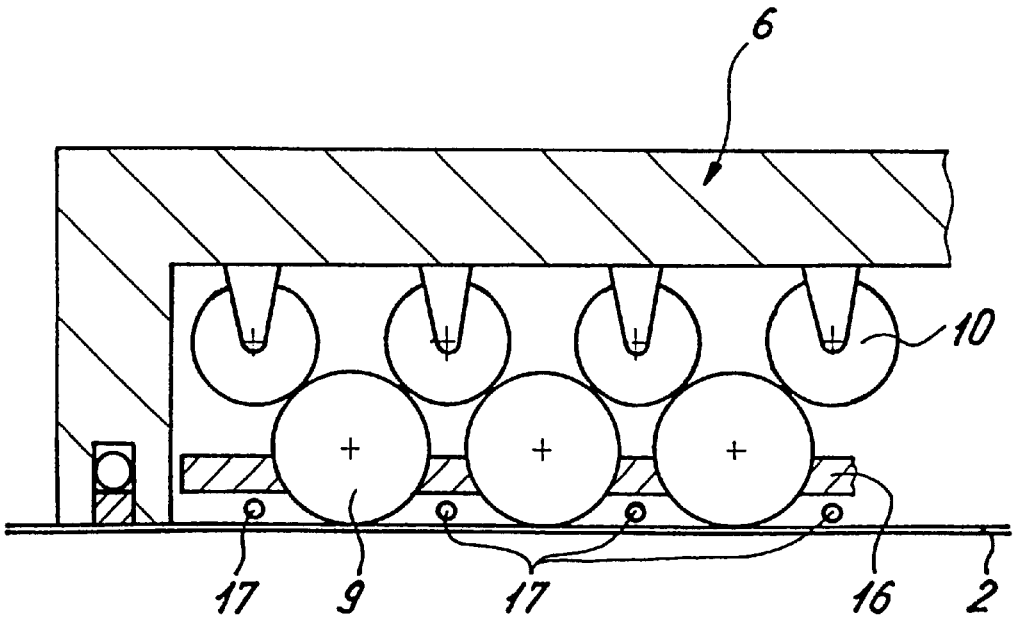
FIG. 2 is a modification of the embodiment of FIG. 1.

On the end faces of the pressure chamber 1, there are located tubular pipes which extend transversely to the transport direction of the band press and which are provided with openings arranged in a row, with the pressure-transmitting medium supplied to the pipes on one end face and extracted on the other end face. In the embodiment of FIG. 1, the pressure-transmitting medium flows through the spaces in the pressure chamber which are bound by the press band 2, the pressure rolls 9 and the bearing rollers 10. In the embodiment of FIG. 2, the spaces through which the pressure-transmitting medium flows, are demarcated by the press band 2, a cage 16 and the pressure rolls 9 and, if necessary, by the side walls 5 of the pressure plate.

For preventing the heat from flowing from the interior space 15 of the pressure chamber to the outside, the bearing rollers 10 can be made from a heat-insulating material.

It is also feasible to fabricate the pressure plate 6 and the side walls 5 which are formed as one piece with the pressure plate, from a heat-insulating material or to provide a heat-insulating layer on the inside wall of the chamber.

In the embodiment of FIG. 2, the pressure rolls 9 are arranged inside a cage 16 wherein the liquid pressure-transmitting medium is supplied and discharged through stubs 17 or pipe bores disposed on the end faces in the pressure chamber between the pressure chamber 2 and the cage 16.

The cage 16 can be made from a heat-insulating material or can be provided with a heat-insulating layer.

In the embodiment of FIG. 2, the cooled or heated pressure-transmitting medium flows through a narrow portion of the interior space of the pressure chamber. In the region of the pressure rolls 9, overflow connections must be provided between the individual subchambers which are bound by the cage 16, the press band 2 and the pressure rolls 9.

Figure 3:
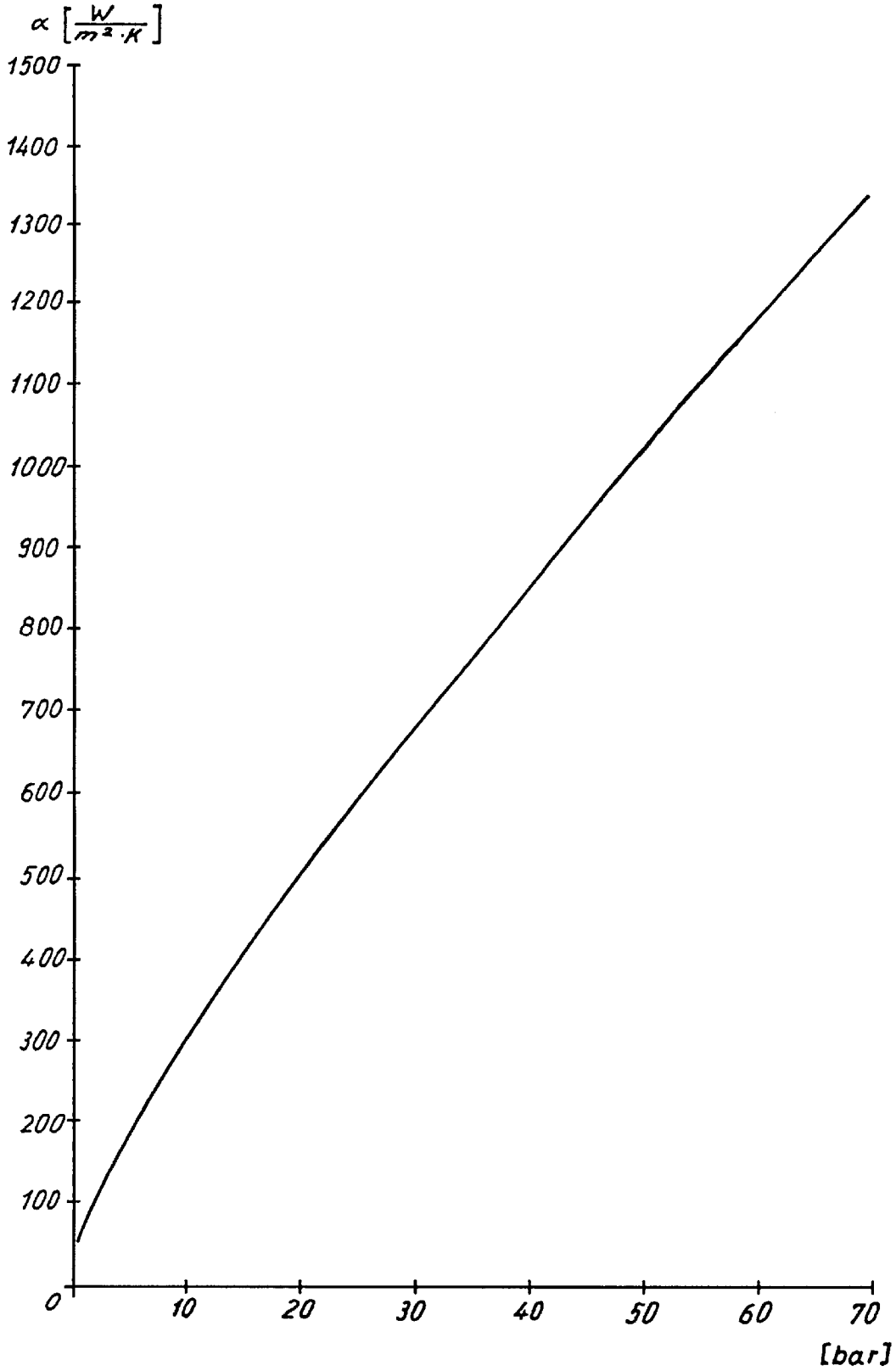
FIG. 3 is a diagram showing the pressure of the liquid pressure-transmitting medium in the pressure chamber plotted on the abscissa and the value of the heat transfer coefficient plotted on the ordinate.

The diagram of FIG. 3 illustrates clearly that the heat transfer coefficient from the heated pressure-transmitting medium to the workpiece increases significantly with increasing pressure of the pressure-transmitting medium in the interior space of the pressure chamber, whereby the heat supply to the workpiece can be controlled separately for each product by adjusting the pressure of the liquid pressure-transmitting medium.

The heat transfer coefficient $\alpha$ plotted on the ordinate of the diagram is defined by w=amount of heat transported per time unit m=area for heat exchange K=temperature difference between the heat-exchanging surface and the liquid pressure-transmitting medium= driving temperature difference.

It can be inferred from the diagram that the size of the pressure chamber used for manufacturing high-pressure laminates can be decreased since the heat transfer coefficient a is very large at higher operating pressure.

What is claimed is:

1. A double band press for makings or for coating plate-or web-shaped work pieces, comprising:

a pair of continuous-loop press bands arranged in opposite disposition to form a reaction zone for passage of material to be pressed;

pressure application means for exerting pressure onto the press bands in the reaction zone, said pressure application means including at least two pressure plates, one pressure plate associated with one of the press bands and another pressure plate associated with the other one of the press bands, each said pressure plate being so configured as to define a pressure chamber which is open on a side facing the press band and including a wraparound seal supported by the press band, said pressure chamber accommodating pressure rolls supported on the press band, and bearing rollers positioned between the pressure rolls and the pressure plate for support of the pressure rolls;

a fluid circulation system for turbulently circulating a pressure-transmitting medium in a short circulatory loop through the pressure chamber and through a unit located outside the pressure chamber for either heating or cooling said medium.

2. The double band press of claim 1 wherein the pressure-transmitting medium flows at an operating pressure and at a velocity through the fluid circulation system, and further comprising means for adjusting the operating pressure and the velocity of the pressure-transmitting medium in the pressure chamber for changing the intensity of a heat transfer from the pressure-transmitting medium onto the material to be pressed.

3. The double band press of claim 1 wherein the bearing rollers are made of heat-insulating material.

4. The double band press of claim 1 and further comprising a cage for retaining the pressure rolls, said pressure-transmitting medium being supplied and discharged between the press band and the cage.

5. The double band press of claim 4 wherein the cage is made of heat-insulating material.

6. The double band press of claim 4 wherein the cage is lined with a heat-insulating layer.

7. The double band press of claim 4 wherein the liquid pressure-transmitting medium flows turbulently through subspaces of the pressure chamber in a transport direction or opposite to the transport direction of the press bands, said subspaces being bounded by the press band, the cage, the pressure rolls and the pressure plate.

8. The double band press of claim 1 wherein the pressure plate has side walls formed in one piece with the pressure plate, said pressure plate and said side walls being made of heat-insulating material.

9. The double band press of claim 1 wherein the pressure plate has side walls formed in one piece with the pressure plate, said pressure plate and said side walls defining an inside wall surface lined with a heat-insulating layer.

10. The double band press of claim 1, and further comprising a frame secured to the pressure plate for rotatably supporting the pressure rolls and the bearing rollers.

11. The double band press of claim 1 wherein the pressure chamber is comprised of a plurality of cassettes, with each cassette including said pressure rolls and said bearing rollers which are rotatably supported in a frame, and wherein either heated or cooled pressure-transmitting medium turbulently flows through each cassette, with the pressure-transmitting medium applying an operating pressure which is adjustable in each cassette.

12. The double band press of claim 1 wherein the liquid pressure-transmitting medium flows turbulently through subspaces of the pressure chamber in a transport direction or opposite to the transport direction of the press bands, said subspaces being bounded by the press band, the pressure rolls, the bearing rolls and the pressure plate.

* * * * *